US009534554B2

(12) United States Patent
Okoshi et al.

(10) Patent No.: US 9,534,554 B2
(45) Date of Patent: Jan. 3, 2017

(54) FUEL INJECTION AMOUNT CALCULATION METHOD AND FUEL INJECTION CONTROLLING APPARATUS

(75) Inventors: Satoru Okoshi, Wako (JP); Kenichi Machida, Wako (JP); Takahiro Kitamura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 647 days.

(21) Appl. No.: 13/525,470

(22) Filed: Jun. 18, 2012

(65) Prior Publication Data

US 2012/0323467 A1 Dec. 20, 2012

(30) Foreign Application Priority Data

Jun. 20, 2011 (JP) ..... 2011-136479

(51) Int. Cl.
*F02D 41/18* (2006.01)
*F02D 41/32* (2006.01)

(52) U.S. Cl.
CPC ..... *F02D 41/182* (2013.01); *F02D 41/32* (2013.01); *F02D 2200/0406* (2013.01)

(58) Field of Classification Search
CPC ..... F02D 41/30; F02D 41/3005; F02D 41/40; F02D 2200/0406; F02D 41/182
USPC ..... 701/103, 104; 123/435, 472, 478, 480
See application file for complete search history.

(56) References Cited

U.S. PATENT DOCUMENTS

| | | | | |
|---|---|---|---|---|
| 5,765,533 | A * | 6/1998 | Nakajima | 123/492 |
| 6,889,664 | B2 * | 5/2005 | Worth et al. | 123/494 |
| 2005/0065707 | A1 | 3/2005 | Kaga | |
| 2005/0188960 | A1 * | 9/2005 | Kishibata et al. | 123/480 |
| 2005/0197760 | A1 * | 9/2005 | Kaga | 701/103 |
| 2009/0132152 | A1 * | 5/2009 | Haraguchi et al. | 701/106 |
| 2011/0041787 | A1 * | 2/2011 | Loeffler et al. | 123/90.15 |

FOREIGN PATENT DOCUMENTS

| | | | |
|---|---|---|---|
| EP | 1837510 | A1 | 9/2007 |
| JP | 3708574 | B2 | 10/2005 |
| JP | 2006-194142 | A | 7/2006 |
| WO | 2006064361 | A1 | 6/2006 |
| WO | 2006082943 | A1 | 8/2006 |

* cited by examiner

*Primary Examiner* — Joseph Dallo
*Assistant Examiner* — Anthony L Bacon
(74) *Attorney, Agent, or Firm* — Squire Patton Boggs (US) LLP

(57) ABSTRACT

A fuel injection amount calculation method calculates a fuel injection amount to an internal combustion engine of a vehicle. The method can include calculating a relative intake pressure which is a difference between an intake pressure peak of intake air upon intake starting of a cylinder of the internal combustion engine and an intake pressure bottom of the intake air upon intake ending. The method can also include calculating the fuel injection amount based on the relative intake pressure.

3 Claims, 6 Drawing Sheets

FUEL INJECTION AMOUNT CALCULATION METHOD AND FUEL INJECTION CONTROLLING APPARATUS

BACKGROUND

Field

Embodiments of this invention relate to a fuel injection amount calculation method and a fuel injection controlling apparatus.

Description of Related Art

Conventionally, a controlling apparatus of an internal combustion engine for electronically controlling the fuel injection amount estimates an air amount to be taken into a cylinder, such air amount is hereinafter referred to simply as intake air amount, and calculates a fuel injection amount in response to the intake air amount. As a calculation method for the fuel injection amount, a method has been proposed in which, assuming that the control accuracy of the air fuel ratio is improved, an intake air amount is estimated from an intake pipe negative pressure and an engine speed of an internal combustion engine when the operation step of a piston is placed at the bottom dead center to determine a fuel injection amount. For example, refer to Patent Document 1 (Japanese Patent No. 3708574).

If time-dependent variation occurs with the tappet clearance of an internal combustion engine, then a displacement appears at opening and closing timings of an intake valve and an exhaust valve. Such displacement of the opening and closing timings of the intake valve and the exhaust valve sometimes makes the displacement of the intake pipe negative pressure in the proximity of the bottom dead center comparatively great although the variation of the actual intake air amount is small. Therefore, the conventional fuel injection amount calculation method described above has a problem that there is the possibility that the displacement between the actual intake air amount and the estimation value of the intake air amount may become comparatively great, resulting in failure in calculation of an optimum fuel injection amount.

SUMMARY

The present invention has been made in view of such a situation as described above, and it is an object of the present invention to provide a fuel injection amount calculation method and a fuel injection controlling apparatus wherein, even if a displacement appears at opening and closing timings of valves due to an assembly error or time-dependent variation of the tappet clearance, a suitable fuel injection amount can be calculated to achieve improvement in fuel cost and purification of exhaust gas.

In order to solve the problem described above, according to one embodiment of the invention, there is provided a fuel injection amount calculation method for calculating a fuel injection amount to an internal combustion engine of a vehicle. The method includes calculating a relative intake pressure such as a relative value which is a difference between an intake pressure peak or peak value of intake air upon starting of air intake of a cylinder of the internal combustion engine, and an intake pressure bottom value of the intake air upon ending of the air intake. The method includes calculating the fuel injection amount based on the relative intake pressure.

According to another embodiment of the invention, the fuel injection amount calculation method is configured such that the fuel injection amount is calculated based on the relative intake pressure and an engine speed of the internal combustion engine.

According to another embodiment of the invention, there is provided a fuel injection controlling apparatus for controlling a fuel injection amount to an internal combustion engine of a vehicle. The apparatus can include an intake pressure sensor configured to detect an intake pressure of a cylinder of the internal combustion engine. A fuel injection system is configured to inject fuel, and a controlling device is configured to control a fuel injection amount by the fuel injection system based on the intake pressure detected by the intake pressure sensor. The controlling device can include a relative pressure detection unit configured to detect a relative intake pressure which is a difference between an intake pressure peak of intake air upon starting of air intake of a cylinder of the internal combustion engine and an intake pressure bottom of the intake air upon ending of the air intake. A fuel amount calculation unit is configured to calculate the fuel injection amount by the fuel injection system based on the relative intake pressure.

According to another embodiment of the invention, the fuel injection controlling apparatus can further include an engine speed sensor configured to detect an engine speed of the internal combustion engine. The fuel amount calculation unit is configured to calculate the fuel injection amount based on the relative intake pressure and the engine speed of the internal combustion engine.

With the embodiments of the invention noted above, by calculating the fuel injection amount based on the relative intake pressure between the intake pressure peak and the intake pressure bottom, even if a displacement appears at opening and closing timings of an intake valve or an exhaust valve due to an assembly error or a time-dependent variation of the tappet clearance and, for example, an influence of a valve overlap between an exhaust timing and an intake timing is had on the intake negative pressure, a fuel injection amount in accordance with a timing of an intake stroke with small variation can be calculated. Therefore, a fuel injection amount corresponding to an actual intake air amount can be calculated, and accordingly, there is an effect that a suitable fuel injection amount can be calculated and improvement regarding the fuel cost and purification of exhaust gas can be achieved.

Where the engine speed of the internal combustion engine differs with the same relative intake pressure, the intake air amount varies in response to the engine speed. However, by calculating the fuel injection amount based on the engine speed and the relative intake pressure, a suitable fuel injection amount can be calculated. Therefore, there can be an effect that further improvement regarding the fuel cost and purification of exhaust gas can be achieved.

DETAILED DESCRIPTION

Now, an embodiment of a fuel injection amount calculation method and a fuel injection controlling apparatus is described with reference to the drawings.

Figure 1:
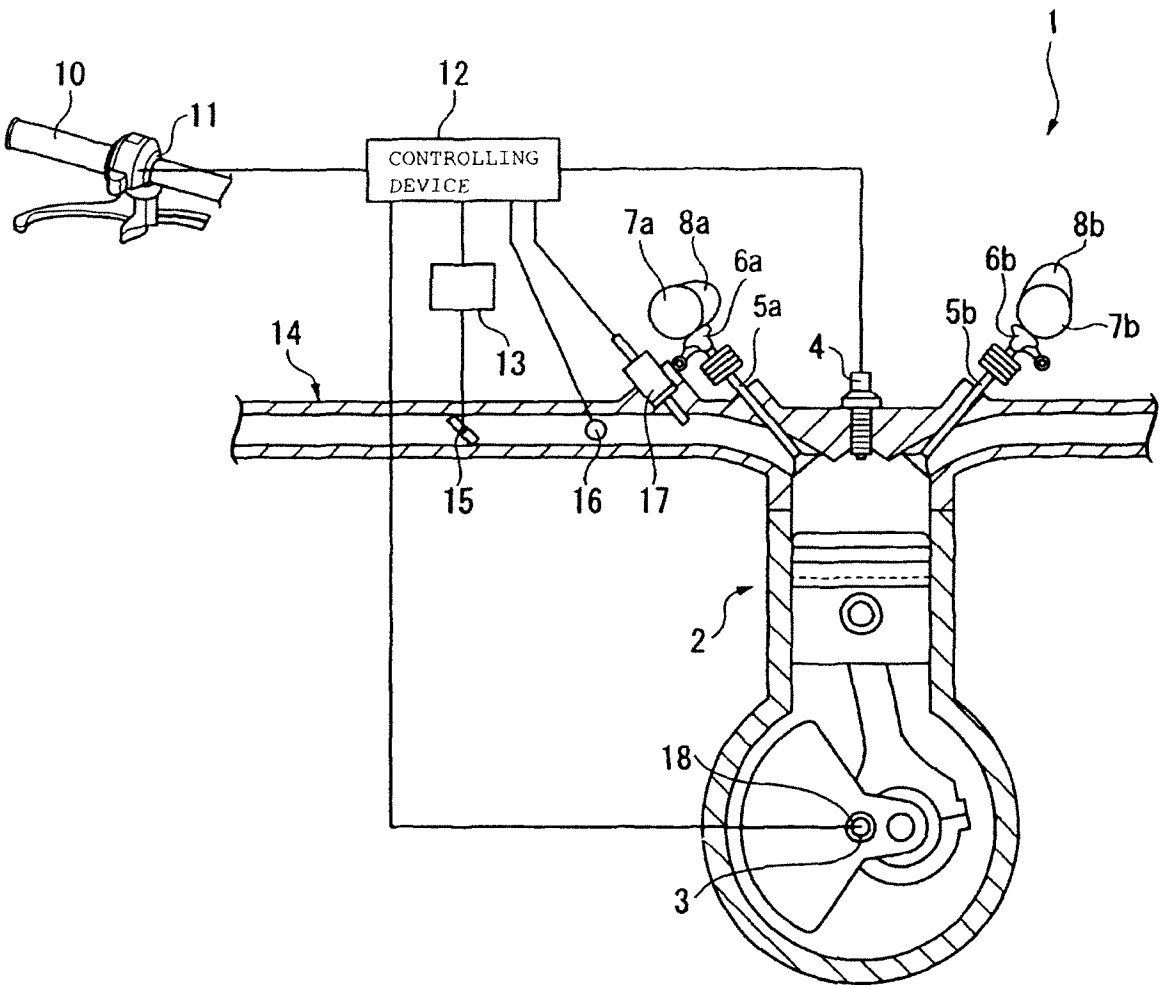
FIG. 1 is a schematic configuration diagram of a fuel injection controlling apparatus of an internal combustion engine according to an embodiment of the present invention.

FIG. 1 shows a fuel injection controlling apparatus of an internal combustion engine according to the embodiment. The fuel injection controlling apparatus 1 is an apparatus for electronically controlling the fuel injection amount to an internal combustion engine 2 of a motorcycle, and carries out so-called by-wire type throttle control. A throttle sensor 11 for detecting an operation amount of a throttle grip 10 is attached to the throttle grip 10, and a result of the detection by the throttle sensor 11 is inputted to a controlling device 12. A throttle valve 15 capable of changing the throttle opening through an actuator 13 is provided in an intake pipe 14 of the internal combustion engine 2, and the controlling device 12 drives and controls the actuator 13 based on a result of the detection by the throttle sensor 11 to adjust the throttle opening.

An intake pipe internal pressure sensor (PB sensor) 16 for measuring the pressure in the intake pipe 14 can be attached to the intake pipe 14 on the downstream side with respect to the throttle valve. A detection signal of the intake pipe internal pressure sensor 16 is inputted to the controlling device 12 described above. Further, an injector 17 for injecting fuel into the intake pipe 14 is attached in an inclined relationship to the intake pipe 14 on the downstream side with respect to the intake pipe internal pressure sensor 16 such that an injection port thereof is directed toward the downstream side. The fuel injection amount of the injector 17 is controlled in accordance with a controlling instruction from the controlling device 12. More particularly, the fuel injection amount is controlled in accordance with an injection period of fuel by the injector 17.

To the controlling device 12, an engine speed sensor 18 for detecting the engine speed of a crank 3 of the internal combustion engine 2 is connected. Further, the controlling device 12 controls the ignition timing of an ignition plug 4 attached to the internal combustion engine 2.

Here, in the internal combustion engine 2 shown in FIG. 1, an intake valve 5*a* for one cylinder is pressed by a cam 8*a* of an intake side camshaft 7*a* through an intake side rocker arm 6*a* provided for each cylinder so as to be operated for opening and closing movements. Similarly, an exhaust valve 5*b* for one cylinder is pressed by a cam 8*b* of an exhaust side camshaft 7*b* through an exhaust side rocker arm 6*b* provided for each cylinder so as to be operated for opening and closing movements.

Figure 2:
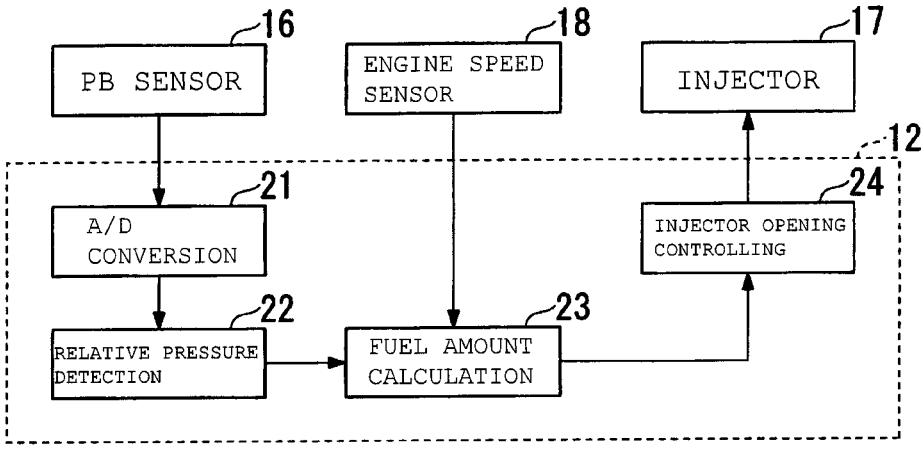
FIG. 2 is a block diagram of a controlling apparatus of the fuel injection controlling apparatus.

As shown in FIG. 2, the controlling device 12 includes an A/D converter 21, a relative pressure detection section, which can be relative pressure detection means 22, a fuel amount calculation section or fuel amount calculation means 23 and an injector opening controlling section 24. It is to be noted that the relative pressure detection section 22, fuel amount calculation section 23 and injector opening controlling section 24 can be implemented by a program executed by an arithmetic operation apparatus (not shown) of the controlling device 12.

The A/D converter 21 digitally converts an analog signal of an intake pipe internal pressure inputted thereto from the intake pipe internal pressure sensor 16 and outputs the digitally converted signal of the intake pipe internal pressure to the relative pressure detection section 22. Here, the A/D converter 21 carries out a timer process such that the sampling period may be, in one embodiment, approximately 160 μs.

The relative pressure detection section 22 reads in an A/D value of the intake pipe internal pressure outputted from the A/D converter 21 and calculates a peak value of the intake pipe internal pressure in the case where the operation step of the piston is at a search stage in the proximity of the top dead center (such stage is hereinafter referred to as peak stage). Further, the relative pressure detection section 22 calculates a bottom value of the intake pipe internal pressure in the case where the operation step of the piston is at a search stage in the proximity of the bottom dead center (such stage is hereinafter referred to as bottom stage). Then, the relative pressure detection section 22 detects a relative pressure which is a difference between the peak value and the bottom value of the intake pipe internal pressure (such relative pressure is hereinafter referred to simply as relative value) and outputs the detected information to the fuel amount calculation section 23.

Here, the relative pressure detection section 22 starts, when the operation step of the piston comes to a starting stage at the peak stage or the bottom stage, reading in of a peak value or a bottom value in accordance with the pertaining search stage, and ends, when the operation step of the piston comes to an ending stage at the peak stage or the bottom stage, the reading in of a peak value and a bottom value in accordance with the pertaining search stage. The relative pressure detection section 22 detects a maximum value at one peak stage as the peak value and detects a minimum value at one bottom stage as the bottom value.

The fuel amount calculation section 23 refers to a map stored in advance in a memory such as a nonvolatile memory or the like (not shown) based on the information of a relative value detected by the relative pressure detection section 22 and the information of an engine speed (NE) inputted from the engine speed sensor 18, to calculate or determine one injection MAP value corresponding to the relative value and the crank engine speed. Then, the fuel amount calculation section 23 calculates an injection period obtained by adding an invalid injection amount to the injection MAP value, and outputs information of the calculated injection period to the injector opening controlling section 24.

Here, the invalid injection amount signifies an injection amount corresponding to a time lag after a controlling instruction to start fuel injection is outputted to the injector 17 until fuel injection is actually started, has a value which varies depending upon specifications of the injector 17 and so forth, and is determined in advance for each injector 17. It is to be noted that, while the foregoing description is given taking the case in which the fuel injection amount is calculated by reference to the map as an example, the reference object is not limited to a map, but, for example, a table may be used as the reference object.

The injector opening controlling section 24 carries out driving control of the injector 17 in accordance with the information of the injection period from the fuel amount calculation section 23. In other words, injector opening controlling section 24 controls the injector 17 to inject fuel for the calculated injection period. It is to be noted that the fuel injection amount per unit time period by the injector 17 is fixed, and the injection amount of the fuel is controlled through the injection period.

Figure 3:
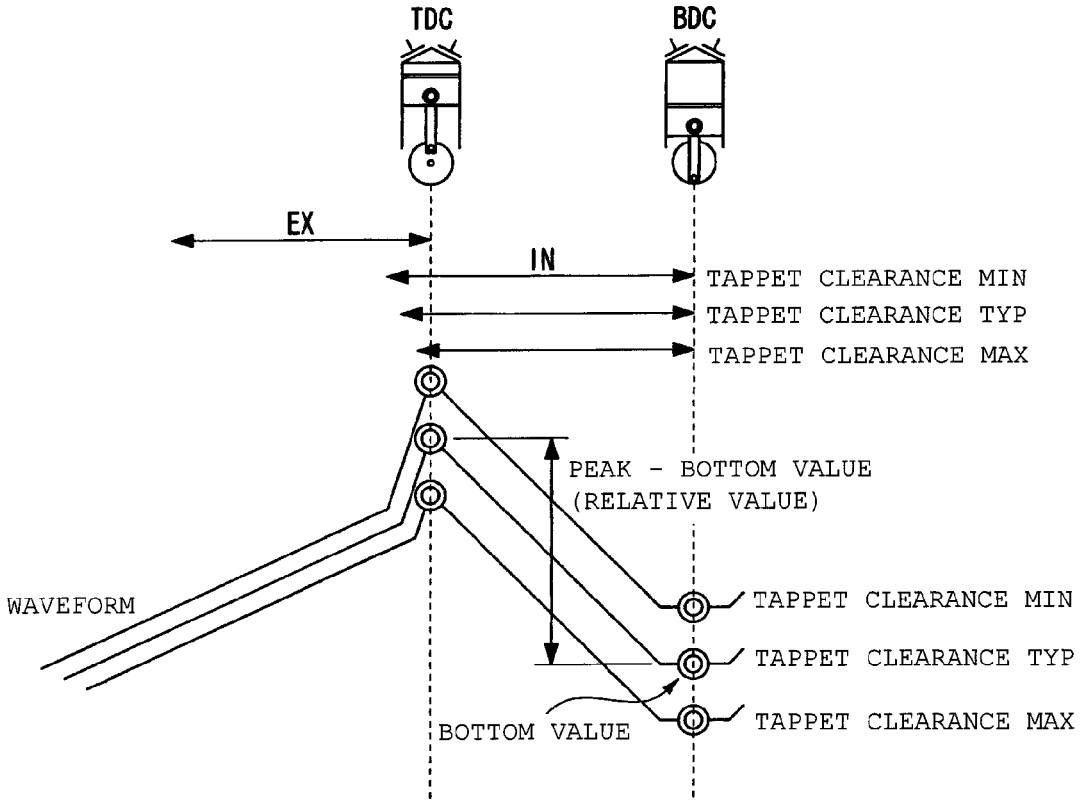
FIG. 3 is an explanatory view illustrating an intake pipe internal pressure for each tappet clearance after an exhaust stroke.

FIG. 3 schematically shows a waveform (PB waveform) of the detection signal of the intake pipe internal pressure sensor 16 when the operation step of the piston transits from the top dead center (TDC) after an exhaust stroke to the bottom dead center (BDC) after an intake process. In particular, FIG. 3 schematically individually shows a waveform in a case (MIN) in which the tappet clearance (indicated in the drawing) on the intake side is in the minimum, that in another case (TYP) in which the tappet clearance is standard and a further case (MAX) in which the tappet clearance is in the maximum, respectively. The tappet clearance in the present embodiment signifies the clearance between the intake side cam 8*a* and intake side rocker arm 6*a* shown in FIG. 1 and the clearance between the intake valve 5*a* and the intake side rocker arm 6*a*. Further, the case in which the tappet clearance is standard described above signifies an average value obtained by measuring the tappet clearance on the intake side of a great number of such internal combustion engines 2.

Here, FIG. 3 is an explanatory view wherein the axis of ordinate indicates the intake pipe internal pressure and the axis of abscissa indicates the time. As shown in FIG. 3, if a valve on the intake side is opened just before an end of the exhaust stroke irrespective of the tappet clearance, then the intake pipe internal pressure rises suddenly until it reaches a maximum value in the proximity of the top dead center at which the exhaust valve is closed. Then, as the piston is displaced toward the bottom dead center, the intake pipe internal pressure gradually drops together with the displacement of the piston until it reaches a minimum value in the proximity of the bottom dead center at which the intake process ends. It is to be noted that the intake pipe internal pressure changes back to the rising tendency after the bottom dead center is passed.

The peak value of the intake pipe internal pressure in the proximity of the top dead center (such peak value is hereinafter referred to simply as peak value of the intake pipe internal pressure) is higher in a case in which the tappet clearance is in the minimum (tappet clearance MIN) than in any other case in which the tappet clearance is in the maximum (tappet clearance MAX) or is standard (tappet clearance TYP). Also the bottom value of the intake pipe internal pressure in the proximity of the bottom dead center (such bottom value is hereinafter referred to simply as bottom value of the intake pipe internal pressure) is higher in the case in which the tappet clearance is in the minimum (tappet clearance MIN) than in the case in which the tappet clearance is in the maximum (tappet clearance MAX) or is standard (tappet clearance TYP). On the other hand, the peak value of the intake pipe internal pressure in the proximity of the top dead center is lower in the case in which the tappet clearance is in the maximum (tappet clearance MAX) than in the case in which the tappet clearance is in the minimum (tappet clearance MIN) or is standard (tappet clearance TYP). Also the bottom value of the intake pipe internal pressure in the proximity of the bottom dead center is lower in the case in which the tappet clearance is in the maximum (tappet clearance MAX) than in the case in which the tappet clearance is in the minimum (tappet clearance MIN) or is standard (tappet clearance TYP). Where the tappet clearance is standard (tappet clearance TYP), both of the peak value in the proximity of the top dead center and the bottom value in the proximity of the bottom dead center are equal to an intermediate value between those in the case of the maximum tappet clearance (tappet clearance MAX) and in the case of the minimum tappet clearance (tappet clearance MIN).

Figure 4:
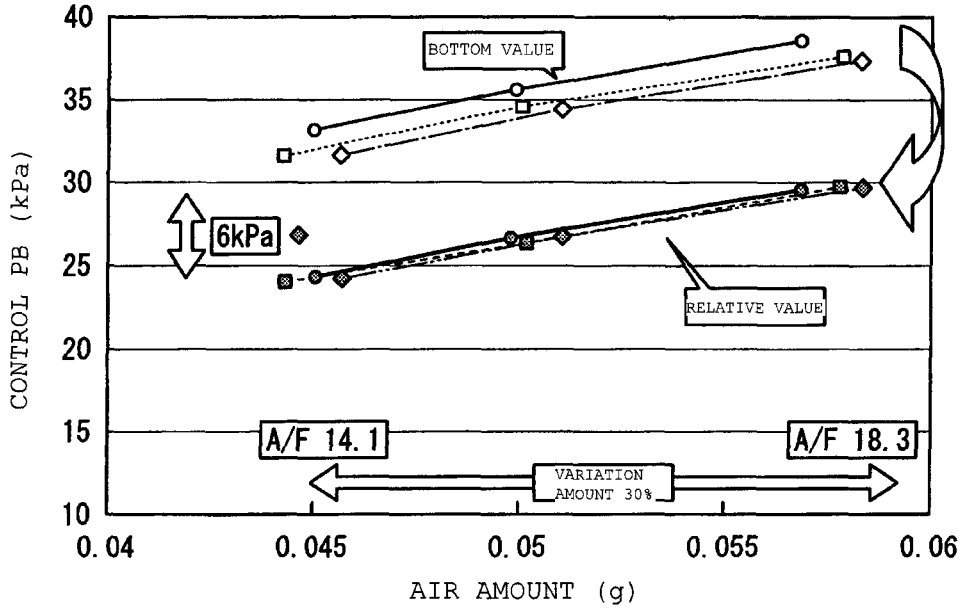
FIG. 4 is a graph illustrating a relationship between a bottom value and an intake air amount and between a relative value and an intake air amount.

FIG. 4 illustrates a variation of the intake amount (g; horizontal axis) of air taken in the cylinder with respect to the control PB (kPa; vertical axis) which is a controlling value of the intake pipe internal pressure. The controlling value of the intake pipe internal pressure signifies the bottom value of the intake pipe internal pressure and a relative value between the peak value and bottom value of the intake pipe internal pressure. Further, the intake air amount signifies an amount of air into which fuel injected from the injector 17 is to be mixed and is required for control of the air fuel ratio, that is, when the fuel injection amount of the injector 17 is determined. Where the air fuel ratio is set equal, if the intake air amount increases, then the fuel injection amount of the injector 17 is controlled to increase, but, if the intake air amount decreases, then the fuel injection amount of the injector 17 is controlled to decrease.

As shown in the graph of FIG. 4, the bottom value increases or decreases in accordance with the magnitude of the tappet clearance. More particularly, the bottom value becomes maximum where the tappet clearance is MAX (indicated by a solid line in FIG. 4) but becomes minimum where the tappet clearance is MIN (indicated by an alternately long and short dash line in FIG. 4), and becomes an intermediate value between the MAX and the MIN just described where the tappet clearance is TYP (indicated by a broken line in FIG. 4). This is because some displacement appears with opening and closing timings of the valve in response to the magnitude of the tappet clearance, and, for example, in the proximity of the top dead center, timings of exhaust (EX) and intake (IN) overlap a little with each other and then the timing of starting of spit back from the cylinder to the intake pipe 14 varies. Then, since the timing at which the intake pipe internal pressure returns to the positive pressure side varies by an influence of the variation of the spit back timing, each waveform itself of the intake pipe internal pressure is offset upwardly or downwardly in response to the tappet clearance. Further, since the peak value is offset, also the bottom value of the intake pipe internal pressure displaces in response to the offset amount.

However, even if the bottom value of the intake pipe internal pressure varies in response to the magnitude of the tappet clearance, the waveforms are only offset from each other and the variation of the amount of air actually taken into the cylinder is very small. For example, if an estimation value of the intake air amount is determined using the bottom value of the intake pipe internal pressure, then the determined estimation value of the intake air amount and the actual intake air amount are displaced by a great amount from each other. Therefore, there is the possibility that optimum fuel injection with respect to the actual intake air amount may not be able to be carried out, and the fuel cost or the environmental performance may drop.

On the other hand, while the relative value between the peak value and the bottom value of the intake pipe internal pressure is lower by 6 kPa than the bottom value of the intake pipe internal pressure, the variation according to the magnitude of the tappet clearance is very small. Further, similarly to the bottom value of the intake pipe internal pressure, the relative value exhibits an increasing tendency in which it increases substantially in proportion to increase of the intake air amount. In particular, by using the relative value between the peak value and the bottom value of the intake pipe internal pressure, the intake air amount can be estimated without being influenced by the displacement of the tappet clearance and so forth. In particular, since the relative value between the peak value and the bottom value of the intake pipe internal pressure and the actual intake air amount vary substantially in proportion to each other, the fuel injection amount of the injector 17 can be calculated using the relative value between the peak value and the bottom value of the intake pipe internal pressure. It is to be noted that, in the graph of FIG. 4, an example is illustrated wherein the air fuel ratio (A/F) is "14.1" where the intake air amount is smallest but is "18.3" where the intake air amount is greatest, and the variation ratio is approximately 30%.

The fuel injection controlling apparatus 1 of the present embodiment has the configuration described above, and a controlling process by the controlling device 12 of the fuel injection controlling apparatus 1 is described below with reference to flow charts.

Figure 5:
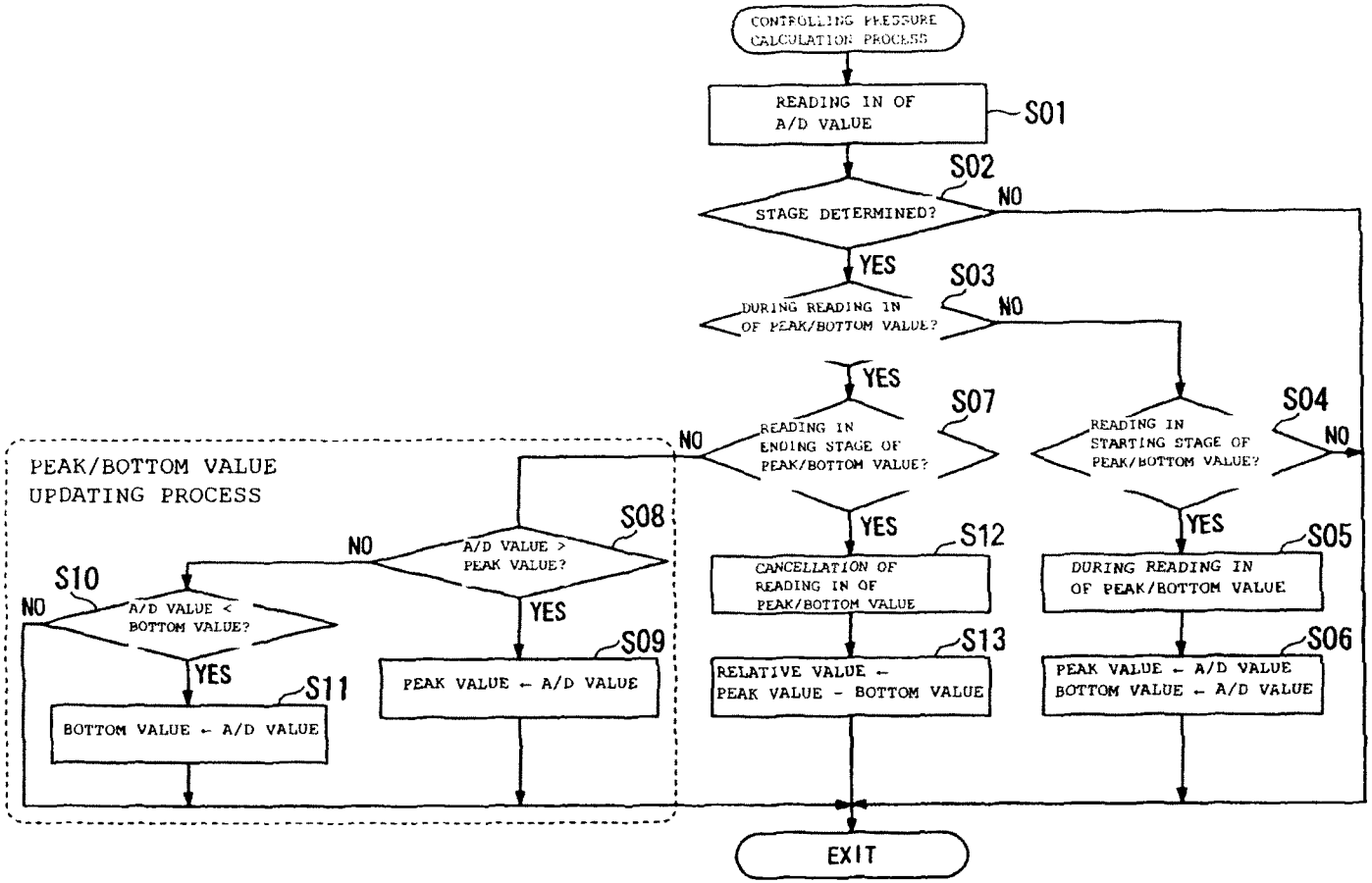
FIG. 5 is a flow chart illustrating a controlling pressure calculation process for map search of the controlling apparatus.

First, a controlling pressure calculation process for map search is described with reference to FIG. 5. This controlling pressure calculation process is executed by a timer process of 160 μs.

At step S01, an A/D value obtained by A/D conversion of a result of the detection by the intake pipe internal pressure sensor 16 is read in.

At step S02, it is decided whether or not a detection stage is determined. If it is decided as a result of the decision at step S02 that a "NO" decision is obtained (a detection stage is not determined), then the series of processes is ended once.

If it is decided as a result of the decision at step S02 that a "YES" decision is obtained (a detection stage is determined), then the processing advances to a process at step S03. Here, the determination of a detection stage signifies that the detection stage is in the proximity of the top dead center at which the peak value is to be detected or in the proximity of the bottom dead center at which the bottom value is to be detected. Further, the state in which the detection stage is determined is the state in which the A/D value described above can be used and is a state in which the peak value or the bottom value of the A/D value can be read in. It is to be noted that the detection stage can be determined based on the operation step of the piston detected based on a crank angle sensor or the like not shown, for example, where the operation step of the piston enters a range of the operation step set in advance.

At step S03, it is decided whether or not the peak value or the bottom value is being read in. If it is decided as a result of the decision at step S03 that a "NO" decision is obtained (the peak value or the bottom value is not being read in), then the processing advances to step S04. On the other hand, if it is decided as a result of the decision at step S03 that a "YES" decision is obtained (the peak value or the bottom value is being read in), then the processing advances to step S07.

At step S04, it is decided whether or not the stage at present is a starting stage at which reading in of the peak value or reading in of the bottom value is to be started. Here, the timing at which the peak value and the bottom value described above appear is sometimes displaced in response to the magnitude of the tappet clearance. Therefore, reading in of the peak value or reading in of the bottom value is started at a point of time at which the starting stage by the operation step set in advance is entered, and the reading in of the peak value or the reading in of the bottom value is ended at a point of time at which the ending stage is entered. It is to be noted that, immediately after the detection stage is determined, since the stage at present is not the starting stage at which the reading in of the peak value or the bottom value is to be started, the decision at step S03 is "NO."

If it is decided as a result of the decision at step S04 that a "NO" decision is obtained (the stage at present is not starting stage of reading in of the peak value and the bottom value), then the series of processes is ended once. On the other hand, if it is decided as a result of the decision at step S04 that "YES" decision is obtained (the stage at present is the starting stage of reading in of the peak value or the starting stage of reading in of the bottom value), then the processing advances to step S05.

At step S05, where the stage at present is the starting stage of reading in of the peak value, a flag of a reading in state is determined as "during reading in of a peak value." However, where the stage at present is the starting stage of reading in of the bottom value, the flag of a reading in state is determined as "during reading in of a bottom value."

Where the stage at present is during reading in of a peak value, an A/D value at present is set to the peak value as an initial value for detecting the peak value at step S06. Similarly, where the stage at present is during reading in of a bottom value, a present A/D value is set to the bottom value. Then, the series of processes described above is ended once.

On the other hand, if it is decided at step S03 that the peak value or the bottom value is being read in, then the processing advances to step S07, at which it is decided whether or not the stage at present is an ending stage at which reading in of the peak value or the bottom value is to be ended. If it is decided as a result of the decision that a "YES" decision is obtained (the stage at present is the ending stage), then the processing advances to step S12, but, if it is decided as a result of the decision that a "NO" decision is obtained (the stage at present is not the ending stage), then the processing advances to step S08.

At step S08, it is decided whether or not the latest A/D value is higher than the peak value set at present. If it is decided as a result of the decision at step S08 that a "YES" decision is obtained (the A/D value>the peak value), then the processing advances to step S09, but, if it is decided as a result of the decision at step S08 that a "NO" decision is obtained (A/D value≤peak value), then the processing advances to step S10.

At step S09, the peak value at present is replaced into the newest A/D value to update the peak value and the series of processes described above is ended.

At step S10, it is decided whether or not the latest A/D value is lower than the peak value set at present. If it is decided as a result of the decision at step S10 that a "YES" decision is obtained (the A/D value<the bottom value), then the processing advances to step S11, at which the latest A/D value is set as the present bottom value. Then, the series of processes described above is ended. Similarly, also when it is decided as a result of the decision at step S10 that a "NO" decision is obtained (A/D value≥bottom value), the series of processes described above is ended. It is to be noted that the processes from step S08 to step S11 described above are repeated until it is decided at step S07 that the stage at present is the ending stage.

On the other hand, if it is decided as a result of the decision at step S07 that a "YES" decision is obtained (the stage at present is the ending stage), then the processing advances to step S12, at which it is cancelled that the flag of the reading in state of the peak value and the bottom value indicates "during reading."

At step S13, the bottom value is subtracted from the peak value to calculate a relative value between the peak value and the bottom value (such relative value is hereinafter referred to simply as relative value). Thereafter, the series of processes described above is ended.

Figure 6:
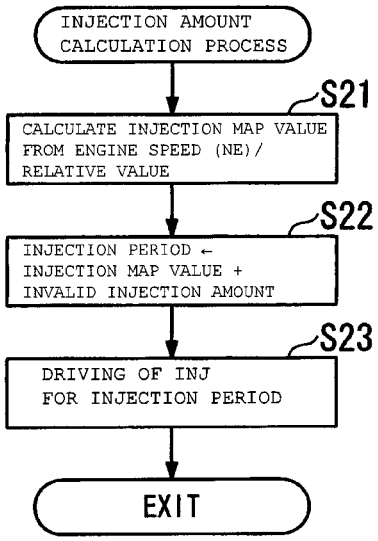
FIG. 6 is a flow chart illustrating an injection amount calculation process of the controlling apparatus.

Now, an injection amount calculation process is described with reference to a flow chart of FIG. 6.

First, at step S21, based on the engine speed detected by the engine speed sensor 18 and the relative value calculated by the process at step S13 described above, a map (not shown) between the engine speed sensor 18 and the relative value stored in advance in storage means is referred to and an injection MAP value of the fuel injection amount is calculated. The map between the engine speed and the relative value is set such that the injection MAP value increases as the engine speed increases and as the relative value increases.

At step S22, an invalid injection amount is added to the injection MAP value and an injection period for which fuel is to be injected by the injector 17 is calculated based on the value obtained by the addition.

At step S23, control for driving the injector 17 is carried out for the injection period calculated at step S22. Then, the series of processes described above is ended.

Accordingly, with the fuel injection amount calculation method of the embodiment described above, by calculating the injection MAP value based on the relative value between the peak value and the bottom value, even if a displacement appears at opening and closing timings of the intake valve or the exhaust valve due to an assembly error of the tappet clearance, time-dependent variation or the like, the injection period corresponding to the actual intake air amount can be calculated. Therefore, the injector 17 can be driven for a suitable injection period so that enhancement regarding the fuel cost and purification of exhaust gas can be achieved.

Further, where the engine speed of the internal combustion engine 2 is different at the same relative value, while the intake air amount varies in response to the engine speed, by calculating the injection MAP value based on the engine speed and the relative value, a suitable injection period can be calculated. Therefore, further enhancement regarding the fuel cost and further purification of exhaust gas can be achieved.

It is to be noted that the present invention is not limited to the configuration of the embodiment described above. Design changes and variations can be made without departing from the spirit or scope of the present invention.

For example, while, in the embodiments described above, the case is described in which the controlling pressure calculation process for MAP search is executed by the timer process of 160 μs, the timer process is not limited to 160 μs but the controlling pressure calculation process may be executed by a timer process of a higher speed than 160 μs or another timer process of a lower speed than 160 μs.

Further, while, in the embodiments described above, the case is described in which by-wire type throttle control is carried out, the present invention can be applied also to a case in which throttle control of a type other than the by-wire type is carried out.

Further, while the so-called DOHC type internal combustion engine 2 in which the intake side camshaft 7*a* and the exhaust side camshaft 7*b* are provided is described as an example with reference to FIG. 1, the present invention is not limited to this. In particular, the present invention can be applied to the internal combustion engine 2 if it includes a valve opening and closing mechanism in which a displacement appears with the tappet clearance.

Further, while the case is described in which the map is referred to based on the engine speed and the relative value to determine an injection MAP value, an estimation value of the intake air amount may be calculated based on the engine speed and the relative value such that an injection MAP value is calculated based on the estimation value of the intake air amount.

Further, while, in the embodiment described above, an internal combustion engine for a motorcycle is described as an example, the present invention can be applied not only to the internal combustion engine for a motorcycle but also to an internal combustion engine for a three-wheel vehicle and a four-wheel vehicle.

DESCRIPTION OF THE REFERENCE NUMERALS

2 Internal combustion engine
12 Controlling device
18 Engine speed sensor
21 A/D converter
22 Relative pressure detection section (relative pressure detection means)
23 Fuel amount calculation section (fuel amount calculation means)
24 Injector opening controlling section

The invention claimed is:

1. A fuel injection amount calculation method for calculating a fuel injection amount to an internal combustion engine of a vehicle, the method comprising:

measuring an engine speed of the internal combustion engine;

measuring an intake pipe internal pressure;

generating an A/D value from the measured intake pipe internal pressure;

calculating a relative intake pressure which is a difference between an intake pressure peak of intake air upon starting of air intake of a cylinder of the internal combustion engine and an intake pressure bottom of the intake air upon ending of the air intake;

calculating an injection MAP value based on the relative intake pressure and the engine speed of the internal combustion engine;

calculating the fuel injection amount by adding an invalid injection amount to the injection MAP value;

replacing the intake pressure peak with the A/D value if the A/D value is greater than the intake pressure peak;

replacing the intake pressure bottom with the A/D value if the A/D value is less than the intake pressure bottom;

controlling the relative intake pressure according to the replaced intake pressure peak and the replaced intake pressure bottom; and controlling a fuel injection system to inject fuel into the internal combustion engine according to the fuel injection amount.

2. A fuel injection controlling apparatus for controlling a fuel injection amount to an internal combustion engine of a vehicle, the apparatus comprising:

an engine speed sensor configured to measure an engine speed of the internal combustion engine;

an intake pipe internal pressure sensor configured to measure an intake pipe internal pressure of a cylinder of the internal combustion engine;

an A/D converter configured to generate an A/D value from the measured intake pipe internal pressure;

a fuel injection system configured to inject fuel; and a controlling device configured to control a fuel injection amount by the fuel injection system according to the intake pipe internal pressure detected by the intake pipe internal pressure sensor, wherein the controlling device includes a relative pressure detection unit configured to detect a relative intake pressure which is a difference between an intake pressure peak of intake air upon starting of air intake of a cylinder of the internal combustion engine and an intake pressure bottom of the intake air upon ending of the air intake; and a fuel amount calculation unit configured to calculate an injection MAP value based on the relative intake pressure and the engine speed of the internal combustion engine, and calculate the fuel injection amount by adding an invalid injection amount to the injection MAP value, wherein the intake pressure peak is replaced with the A/D value if the A/D value is greater than the intake pressure peak, wherein the intake pressure bottom is replaced with the A/D value if the A/D value is less than the intake pressure bottom, and wherein the controlling device is configured to control the relative intake pressure according to the replaced intake pressure peak and the replaced intake pressure bottom.

3. A fuel injection controlling apparatus for controlling a fuel injection amount to an internal combustion engine of a vehicle, the apparatus comprising:

an engine speed sensor means for measuring an engine speed of the internal combustion engine;

intake pipe internal pressure sensor means for measuring an intake pipe internal pressure of a cylinder of the internal combustion engine;

an A/D converter means for generating an A/D value from the measured intake pipe internal pressure;

fuel injection means for injecting fuel; and controlling means for controlling a fuel injection amount by the fuel injection means according to the intake pipe internal pressure detected by the intake pipe internal pressure sensor means, wherein the controlling means includes relative pressure detection means for detecting a relative intake pressure which is a difference between an intake pressure peak of intake air upon starting of air intake of a cylinder of the internal combustion engine and an intake pressure bottom of the intake air upon ending of the air intake; and fuel amount calculation means for calculating an injection MAP value based on the relative intake pressure and the engine speed of the internal combustion engine, and for calculating the fuel injection amount by adding an invalid injection amount to the injection MAP value, wherein the intake pressure peak is replaced with the A/D value if the A/D value is greater than the intake pressure peak, wherein the intake pressure bottom is replaced with the A/D value if the A/D value is less than the intake pressure bottom, and wherein the controlling means controls the relative intake pressure according to the replaced intake pressure peak and the replaced intake pressure bottom.

* * * * *